US007104492B1

(12) United States Patent
Massell et al.

(10) Patent No.: US 7,104,492 B1
(45) Date of Patent: Sep. 12, 2006

(54) CABLE WINDER GUIDE

(75) Inventors: George Massell, Clearwater Beach, FL (US); Richard Massell, Safety Harbor, FL (US)

(73) Assignee: Deco Power Lift, Inc., Safety Harbor, FL (US)

( * ) Notice: Subject to any disclaimer, the term of this patent is extended or adjusted under 35 U.S.C. 154(b) by 70 days.

(21) Appl. No.: 10/807,677

(22) Filed: Mar. 24, 2004

Related U.S. Application Data

(60) Provisional application No. 60/457,224, filed on Mar. 25, 2003.

(51) Int. Cl.
*B65H 27/00* (2006.01)

(52) U.S. Cl. ..... 242/397; 242/397.3; 242/615.3; 242/615.4; 254/333

(58) Field of Classification Search ..... 242/615.3, 242/397.3, 397, 548, 566, 615, 615.4; 254/333
See application file for complete search history.

(56) References Cited

U.S. PATENT DOCUMENTS

| | | | | |
|---|---|---|---|---|
| 1,281,007 | A | | 10/1918 | Hooker |
| 1,850,676 | A | | 3/1932 | Kieneman |
| 1,850,677 | A | | 3/1932 | Kieneman |
| 2,625,373 | A | * | 1/1953 | Hunt ..... 254/333 |
| 2,742,261 | A | | 4/1956 | Arnold |
| 2,917,279 | A | | 12/1959 | Arnold |
| 3,012,757 | A | * | 12/1961 | Marzolf ..... 254/333 |
| 3,150,861 | A | | 9/1964 | Ahlbin |
| 3,260,508 | A | | 7/1966 | Powell |
| 3,416,748 | A | * | 12/1968 | Bliss ..... 242/397.3 |
| 3,481,582 | A | | 12/1969 | Ulbing |
| 3,614,067 | A | * | 10/1971 | Vermette ..... 254/333 |
| 4,244,561 | A | * | 1/1981 | Campbell et al. ..... 254/333 |
| 4,634,078 | A | | 1/1987 | Kaufmann et al. |
| 4,842,251 | A | | 6/1989 | Porter |
| 5,370,367 | A | | 12/1994 | Zaguroli |
| 5,553,832 | A | | 9/1996 | Zaguroli |
| 6,062,543 | A | | 5/2000 | Kobayasi et al. |
| 6,098,962 | A | | 8/2000 | Henly |

* cited by examiner

*Primary Examiner*—William A. Rivera
(74) *Attorney, Agent, or Firm*—Frijouf, Rust & Pyle, P.A.

(57) ABSTRACT

A cable winder guide is disclosed comprising a cylindrical drum having a cylindrical surface with a shaft rotatably mounting the cylindrical drum. A drive is provided for rotating the cylindrical drum about the shaft. A helical groove is defined in the cylindrical surface of the drum for retrieving and releasing the cable upon rotation of the cylindrical drum. A cable retainer is disclosed for resiliently engaging the cable when the cable is located within the helical groove for maintaining the cable within the helical groove.

16 Claims, 4 Drawing Sheets

CABLE WINDER GUIDE

CROSS-REFERENCE TO RELATED APPLICATIONS

This application claims benefit of U.S. Patent Provisional application Ser. No. 60/457,224 filed Mar. 25, 2003. All subject matter set forth in provisional application Ser. No. 60/457,224 is hereby incorporated by reference into the present application as if fully set forth herein.

BACKGROUND OF THE INVENTION

1. Field of the Invention

This invention relates to hoisting devices and more particularly to a cable winder guide for maintaining the cable within a helical groove on a drum.

2. Background of the Invention

Soon after the first successful stranded iron wire rope was developed in 1834, wire rope proved so superior to hemp rope in serviceability and cost that the use of wire rope soon became widespread in European mining and eventually throughout the rest of the world with broadening applications. Most wire ropes used today are utilized in hoisting and hauling operations. Machinery for these purposes, such as cranes, power shovels, elevators, and hoists, requires a strong, flexible rope. Machinery of this type produces rapid movement and substantial bending stresses on wire rope or cable. The flexibility and strength of wire rope or cable has proven to be ideally suited to meet these stringent requirements.

A hoist is a mechanical device used primarily for raising and lowering heavy loads. Occasionally, hoists may be employed for moving objects horizontally. A hoist generally comprises a combination of one or more fixed pulleys and a moving pulley arranged in a block and tackle configuration. A load attaching means is provided which may be a hook or other similar arrangement or device. A rope (or cable) extends between the load and the motive power for the hoist. The motive power may be either manual or supplied by a mechanical driven engine or an electrical motor device. Manual, mechanical, or electrically powered hoists are commonly mounted to the floor or wall, and are used for varied lifting and hauling operations in factories and warehouses.

Some special purpose adaptations of hoists have been developed as needs have arisen and been identified in the art. One such development resulted in a device which is useful for lifting watercraft from the water for storage. The advantages of removing a vessel from the water are well known to those skilled in the art. The damaging effects resulting from retaining a vessel within the water include tide and wave motion damage to the vessel, harsh destructive effects of electrolysis, the exposure to the hull of marine organisms, and winter freezing. These damaging effects are eliminated or removed when the vessel is removed from the water by a hoist or other means.

As a hoist lifts a load, the retrieved cable is wound about a take-up reel or drum. If the cable becomes skewed and overlaps an adjoining cable turn, this results in a serious binding of the retrieved cable. The binding of the cable prevents release of the cable and subsequent movement of the load. The problem of cable binding has been addressed with limited success by the prior art.

U.S. Pat. No. 1,281,007 to Edward D. Hooker teaches that class of hoisting machinery in which the hoisting cable is wound spirally in a corresponding groove on the winding-drum. The object of the invention is to provide simple, inexpensive means for retaining the cable properly in the groove and preventing the coils from riding one upon another when the cable is relaxed and the helix formed thereby tends to expand. The improvement serves usefully with cables of any materials but is of special advantage when wire cables are employed having the stiffness and elasticity inherent in cables of that description. The invention consists in certain novel features of construction and arrangement by which the above objects are attained.

U.S. Pat. Nos. 1,850,676 and 1,850,677 U.S. patent to H. F. Kieneman teaches improvements in hose reels of the type adapted to be trundled over the ground for the purpose of winding and unwinding the hose on and off a winding drum that is revolved by tractive power developed in, the hose reel or appliance. The appliance of this invention is adapted especially for use with rubber hose of the type used to sprinkle gardens lawns and to other, grassy plots. The structure of this type of hose possesses elasticity or resiliency sufficiently to maintain its tubular form and thereby pre vent flattening of the hose as it is wound on the drum. In carrying out the invention this type of hose can be wound or coiled on the drum of the reel in such manner as not to obstruct the free flow of water through the coiled or wound hose and on the other hand the water may freely flow through that portion of the hose that remains on the drum while the hose is being used to sprinkle a lawn or garden.

U.S. Pat. No. 2,917,279 to Carter H. Arnold relates to hoisting devices of the type that may be employed to support scaffolds or to pull rope and is similar in some respects to the hoist shown in U.S. Pat. No. 2,742,261 to Carter H. Arnold. In the above noted patent (e.g. U.S. Pat. No. 2,742,261) there is disclosed a hoisting device adapted to be employed with a hoist having a loaded run and an unloaded run and in which a plurality of loops are formed, portions of which are wrapped around the drum and portions wrapped around means spaced from the drum. By the invention of the cited patent the hoist and its supported structure may be moved along the length of a rope, or the hoist, if held stationary, maybe employed to pull rope relative thereto. The instant invention (e.g. U.S. Pat. No. 2,917,279), although having the same general mode of operation of the above noted invention, has certain advantages thereover in the cited patent the rope is subjected to sudden changes in direction which tend to increase the bending stresses therein. In addition, the means for transferring the rope from one winding to the adjacent winding must be relatively strong to withstand the relatively high tensions in the rope, thus increasing the cost of manufacture and in some instances, resulting in relatively high friction loses. The main object of the present invention is therefore to overcome certain disadvantages of the above noted type of hoist. Another object of the invention is the provision of a single drum hoist that does not subject the rope to sharp changes in direction and which therefor does not build up high stresses in the rope.

U.S. Pat. No. 3,150,861 to Fred E. Ahlbin teaches cable winches in which a driven reel winds up a length of cable thereon, and the present application is a continuation-in-part of his prior application Ser. No. 827,639, filed Jul. 16, 1959, and now abandoned. Prior to the present invention many types of winches have been devised to wind up on reels lengths of relatively stiff wire rope or steel wire cable. Experience of those skilled in the practical art has led them to adopt uniformly, the conclusion that such cable, even when of the small diameters, could not be wound up consistently on reels with the successive turns in each course or layer neatly laid down about the reel tread or core barrel in adjacent orderly fashion if the core barrel or tread is less than three inches in diameter. This was particularly evident after a cable had been repeatedly strained underloads during successive reelings and become worn or abraded by considerable service. Turns of a steel wirecable have considerable spring action tending to straighten out the lengths thereof in the turns, which tendency is greater in turns of smaller diameter. Consequently, when such strained and worn cable is wound up on drams or reel barrels of small diameter without suitable guiding confinement the turns frequently skew and the cable kinks and tangles up on the small drums or barrels during the winding. This tendency is also present to a degree in the use of larger reeling drums and barrels. Many complicated and costly traveling guiding devices have been devised for the purpose of eliminating or minimizing this difficulty and these have had a degree of success in heavy winch equipment for large cables. However, it is not practical to use such devices in economical winch structures for the smaller cables. It is an object of the present invention to eliminate these problems or minimize them to a practical degree. Another object of the present invention is to provide a very simple constructed guiding means for small diameter cable, eg., of the order of five thirty seconds of an inch) in diameter, which is economically produced in mass manufacturing procedure and readily mounted in simple winches for such service, such guiding means requiring no traverse traveling parts while serving effectively to lay down on the reels thereof in orderly fashion the successive cable turns.

U.S. Pat. No. 3,260,508 to Edgar R. Powell teaches a hoist for transporting heavy loads from one location to another and more particularly to a balancing hoist which relieves most of the weight of the load to enable an operator to manually move a heavy load between locations. A balancing hoist according to the invention includes a chamber or cylinder containing a fluid, usually air, under pressure, with the air being compressed as a load carried by the hoist is lowered and with the air being allowed to expand as the load is raised. With this arrangement, part of the load is offset or balanced by the air pressure when the load is raised or lowered or remains stationary. By regulating the pressure of the air in the hoist chamber, a load of almost any size can be handled with case. Since a product or load of a particular size and weight is usually handled by the hoist, being transferred from one conveyor to another, for example, the pressure in the cylinder can be regulated to balance that load so that no further adjustment is required. The pressure is preferably set so that a small force is required to raise and lower the load with this force usually being from about two percent to about ten percent of the actual weight of the load. The hoist operator can then move the load about, raising and lowering it, as though it weighed but a few pounds. The operator thus exercises and uses the same muscles he otherwise would if carrying a load directly but does so without strain or becoming tired.

U.S. Pat. No. 3,481,582 to O. M. Ulbing relates to cable or rope hoists, winches, reels, and the like and especially to rope suspending reel assemblies, and teaches a rope suspending reel with a helical rope groove rotatably supported on an axis which is canted at an angle to align the rope directly with the groove.

U.S. Pat. No. 4,634,078 to Kaufmann et al. teaches a rope guide having a threaded guide segment and a threaded holding segment with a hold down device covering at least a part of a single rope loop on a grooved drum; the segments are made of a synthetic material and their threadings engage the groove of the drum; a slot forming element is fastened to the guide segment and the rope runs through the slot towards the drum; roller mounts are mounted by a pin on the guide segment and carry spring biased rollers forcing the rope into the drum groove.

U.S. Pat. No. 4,842,251 to G. A. Porter teaches a pulley assembly provided for an operating cord. The pulley has a body with a rotational axis and an annular outer surface concentric with the rotational axis. A cord retention member has a surface to be situated around the annular outer pulley surface in operative relationship with the pulley and extending more than 180 degrees around the annular outer pulley surface. Structure is provided on the pulley and cord retention member to cooperate with the cord so that the cord prevents separation of the pulley and cord retention member from their operative relationship.

U.S. Pat. No. 5,370,367 to J. Zaguroli, Jr. teaches a safety device for an air balancing hoist including one or more piston and cylinder shock absorbers engaged by one end of the drum ball nut, which creates a substantial retarding force at high speed but does not generate significant impeding forces at low speeds.

U.S. Pat. No. 5,553,832 to J. Zaguroli, Jr. teaches an air balancing hoist having an axially movable drum reel supported on a ball nut and screw with a piston defining a pressure chamber containing regulated air pressure acting on one end of the drum reel to counter the unwinding force of a load supported on a cable wound on the drum reel. A centrifugal brake retards drum rotation when there is a sudden release of the load tending to cause too rapid wind up of the cable by the regulated air pressure applied on the piston.

U.S. Pat. No. 6,062,543 to E. Kobayasi et al. teaches a hand operated chain block which is capable of fixing as end of a load chain of unloading side and also ensuring smooth wind up and down operation of the load chain, while reducing the size of chain block. In the hand operated chain block, the fixing pin is located at a position in a marginal portion around each side plate such that an interval between a chain split and a rotation trail of a tip of an end portion on the loading side of the first link of the load chain rotatably supported by the fixing pin can be made larger than a width of a link of the load chain, and also that when a full length of the load chain of loading side is wound down, an end portion on the loading side of the second link next to the first link can abut with the end portion on the unloading side of the chain guide.

U.S. Pat. No. 6,098,962 to N. C. Henly teaches a gypsy-type winch having a sheave for driving a rope, chain or rope-chain pulling element. The pulling element is urged into contact with the sheave by a spring assembly acting on the element at positions spaced apart from each other and in different sides respectively of a first diameter extending between the inlet and outlet runs of the element, but both on one side of a second diameter perpendicular to the first.

Therefore, it is an object of the present invention to provide an improved cable winder guide which overcomes some of the deficiencies of the prior art.

Another object of this invention is to provide an improved cable winder guide for a retainer resiliently engaging the cable and maintaining the cable within a helical groove.

The foregoing has outlined some of the more pertinent objects of the present invention. These objects should be construed as being merely illustrative of some of the more prominent features and applications of the invention. Many other beneficial results can be obtained by applying the disclosed invention in a different manner or modifying the invention with in the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention relates to an improved cable winder guide apparatus. The apparatus comprises a cylindrical drum having a cylindrical surface, with a shaft rotatably mounting the cylindrical drum. A drive is provided for rotating the cylindrical drum about the shaft. A helical groove is defined in the cylindrical surface for retrieving and releasing the cable upon rotation of the cylindrical drum. A cable retainer is provided for resiliently engaging the cable when the cable is located within the helical groove of the cylindrical drum for maintaining the cable within the helical groove.

In a more specific embodiment of the invention, the helical groove on the cylindrical surface of the drum has a depth substantially greater than one half and less than three quarters cable diameters.

In one embodiment of the invention, the cable retainer defines a substantially semi-cylindrical shape having a diameter greater than the drum diameter and less than the drum diameter plus one cable diameter.

In a more specific embodiment of the invention, the cable winder guide comprises a polymeric material.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
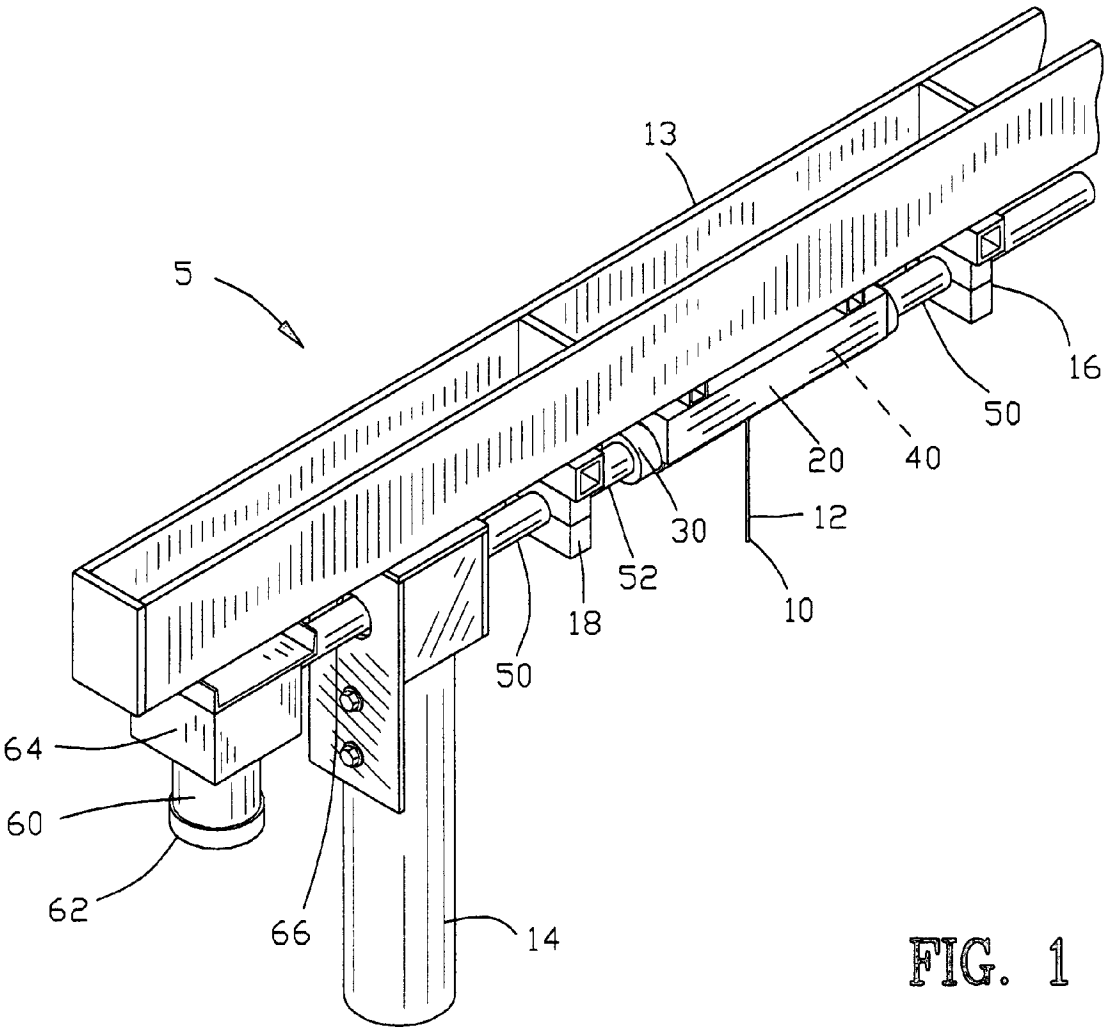
FIG. 1 is an isometric view of a cable winder guide installed in a working environment.

FIG. 1 illustrates a cable winder guide 5 of the present invention. In this example, the cable winder guide 5 is shown as a boat lift assembly. Although the cable winder guide 5 is shown as a boat lift assembly, it should be understood that the cable winder guide 5 may be used in other applications. The cable winder guide 5 of the present invention provides for the safe and reliable winding and unwinding of a cable 10.

The cable winder guide 5 is mounted on a horizontal support member 13 affixed to a vertical support member 14. The cable winder guide 5 comprises a cable retainer 20 and a cylindrical drum 30. The cable retainer 20 is affixed to the horizontal support member 13. A cylindrical drum 30 is affixed to a shaft 50. A helical groove 40 is defined in the cylindrical drum 30 as will be discussed in further detail hereinafter. The shaft 50 is rotatably suspended from the horizontal support member 13 by journals 16 and 18. A drive 60 is affixed to the horizontal support member 13 for rotating the shaft 50.

The drive 60 is shown as an electric motor 62 for driving a speed reduction drive system 64 having an output shaft 66. The output shaft 66 of the speed reduction drive 64 is affixed to the shaft 50 for rotating the cylindrical drum 30. It should be understood that other drive systems including manually operated winches, hydraulic drive systems and the like may be employed as the drive 60 without departing from the spirit of the invention.

Preferably, the drive 60 is a bi-directional drive for rotation in a first and a second rotational direction. A rotation of the drive 60 in the first direction causes the shaft 50 and the cylindrical drum 30 to rotate in a first direction for wrapping the cable 10 about the cylindrical drum 30 to retrieve the cable 10. A rotation of the drive 60 in a second direction causes the shaft 50 and the cylindrical drum 30 to rotate in a second direction for unwrapping the cable 10 from the cylindrical drum 30 to release the cable 10.

Figures 2, 3:
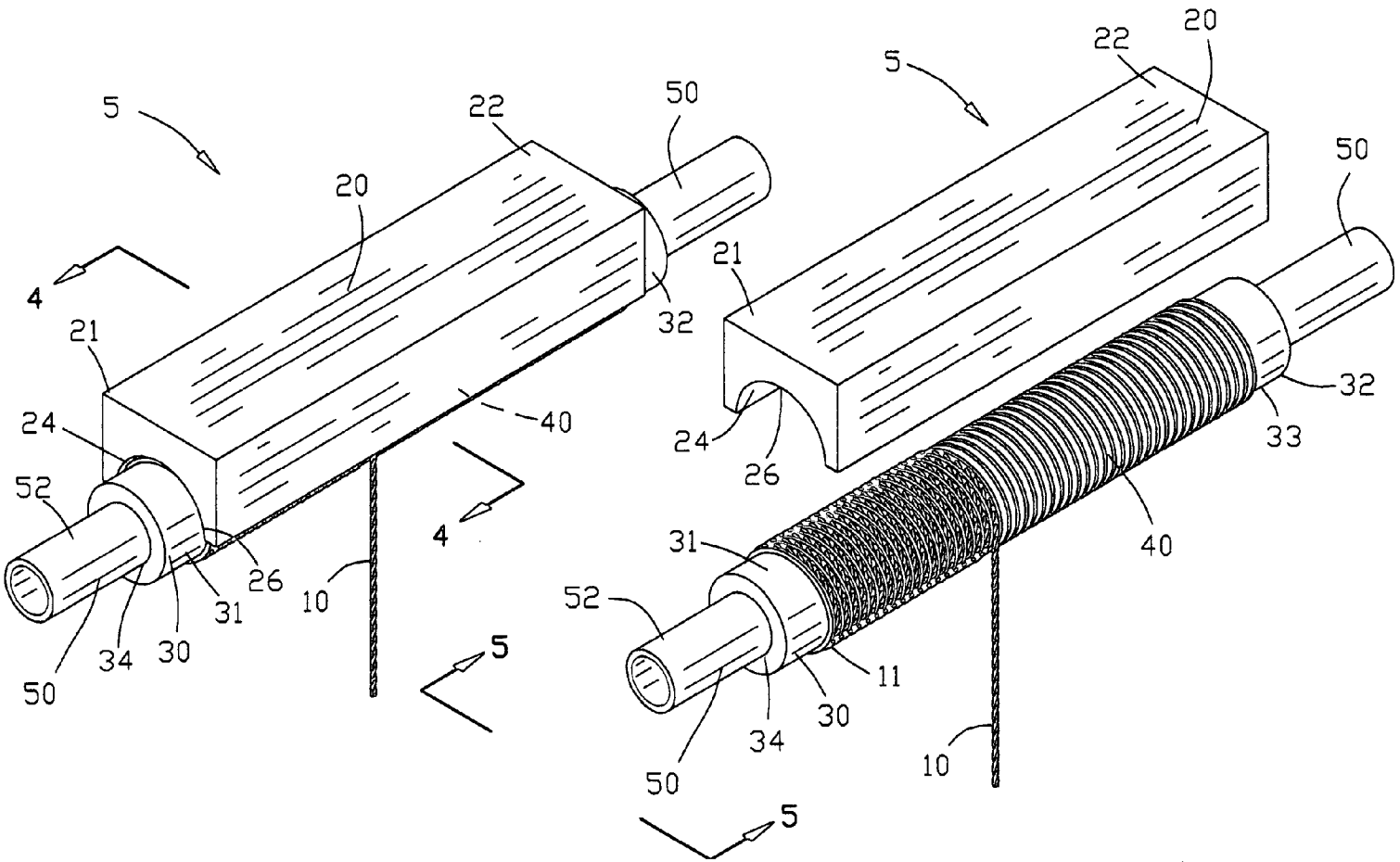
FIG. 2 is an isometric view of the cable winder guide of the present invention.
FIG. 3 is an exploded isometric view of a cable winder guide with the retainer illustrated displaced from the cable drum.

FIGS. 2 and 3 are isometric views illustrating the cable winder 5 in an operational position and in an exploded position, respectively. The cylindrical drum 30 extends between a first and a second end 31 and 32 and defines an outer cylindrical surface 33. Preferably, the cylindrical drum 30 is fabricated from a non-corrosive metallic material. In one embodiment the cylindrical drum 30 is fabricated from 6061 Aluminum. The cylindrical drum 30 has an inner diameter 34 being substantially equal to outer diameter 52 of the shaft 50. The cylindrical drum 30 is affixed to the shaft 50 by welding or alternately using mechanical fasteners such as shaft keys, set screws or the like.

The helical groove 40 is formed within the outer cylindrical surface 33 of the cylindrical drum 30. A first end 11 of the cable 10 is affixed to a first end 31 of the cylindrical drum 30 proximate the helical groove 40.

The cable retainer 20 extends between a first and a second end 21 and 22. Preferably, the first and second ends 21 and 22 of the cable retainer 20 are coextensive with the first and second ends 31 and 32 of the cylindrical drum 30. The cable retainer 20 has a semi-cylindrical surface 24 having a cylindrical diameter 26.

The cable retainer 20 is formed from a resiliently deformable material. In one example of the invention, the cable retainer 20 is fabricated from a polymeric material, such as a mixture of polyethylene and polypropylene or the like. The cable retainer 20 is located immediately adjacent to the cylindrical drum 30 enabling the cable retainer 20 to resiliently engage with the cable 10 to maintain the cable 10 within the helical groove 40. Preferably, the cylindrical diameter 26 of the semi-cylindrical surface 24 of the cable retainer 20 is dimensioned to resiliently engage the cable 10 when the cable 10 is located within the helical groove 40 of the cylindrical drum 30.

Figure 5:
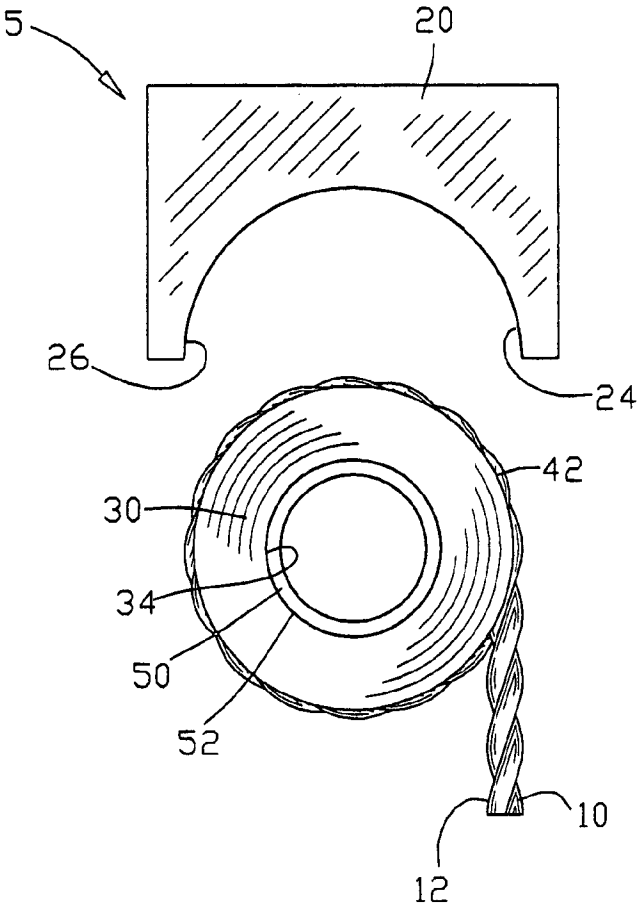
FIG. 5 is an end view of the cable winder guide of FIG. 3.
Figure 4:
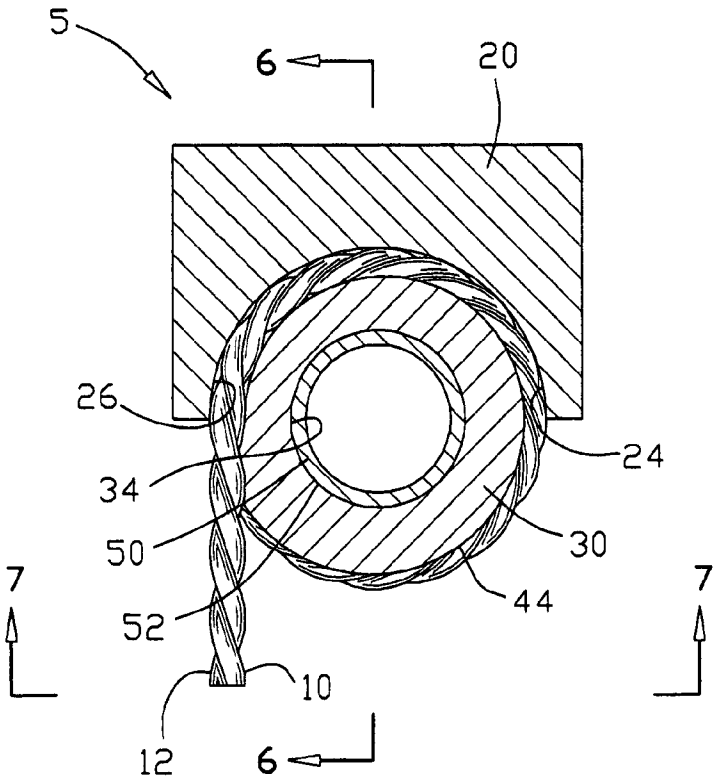
FIG. 4 is a cross-sectional view through line 4—4 of FIG. 2.

FIGS. 4 and 5 are sectional and end views along lines 4—4 and 5—5 in FIGS. 2 and 3 respectively. The inner diameter 34 of the cylindrical drum 30 is substantially equal to the outer diameter 52 of the shaft 50. The cylindrical drum 30 is affixed to the shaft 50 as previously described. The helical groove 40 is defined in the outer cylindrical surface 33 of the cylindrical drum 30. The helical groove 40 defines a cylindrical drum outer diameter 42, an inner diameter 44 and a groove depth 46. The groove depth 46 is selected in accordance with the cable diameter 12 of the cable 10. The groove depth 46 is selected to be more than one half cable diameter 12 and less than three quarters cable diameter 12.

The cable retainer 20 defines a semi-cylindrical surface 24 having a cylindrical diameter 26. The cylindrical diameter 26 of the semi-cylindrical surface 24 of the cable retainer 20 is selected in accordance with the cylindrical drum outer diameter 42, the groove depth 46 and the cable diameter 12. The cylindrical diameter 26 of the semi-cylindrical surface 24 of cable retainer 20 is selected to be within the range of greater than the cylindrical drum outer diameter 42 and less than the cylindrical drum outer diameter 42 plus two times the cable diameter 12. Maintaining the cylindrical diameter 26 of the semi-cylindrical surface 24 of cable retainer 20 within these limits enables the cable retainer 20 to perform the function of maintaining the cable 10 within the helical groove 40 of the cylindrical drum 30. Any increase in the cylindrical diameter 26 of the semi-cylindrical surface 24 of cable retainer 20 would permit the cable 10 to be displaced from the helical groove 40 on the cylindrical outer surface 33 of the cylindrical drum 30. The exact dimensions of the cylindrical diameter 26 of the semi-cylindrical surface is dependent upon the criteria previously discussed.

Figure 6:
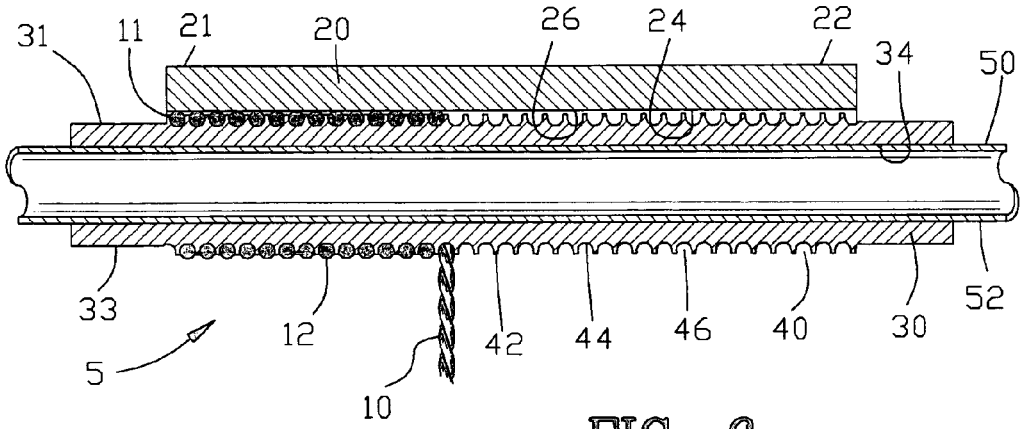
FIG. 6 is an cross-sectional view through line 6—6 of FIG. 4.
Figure 7:
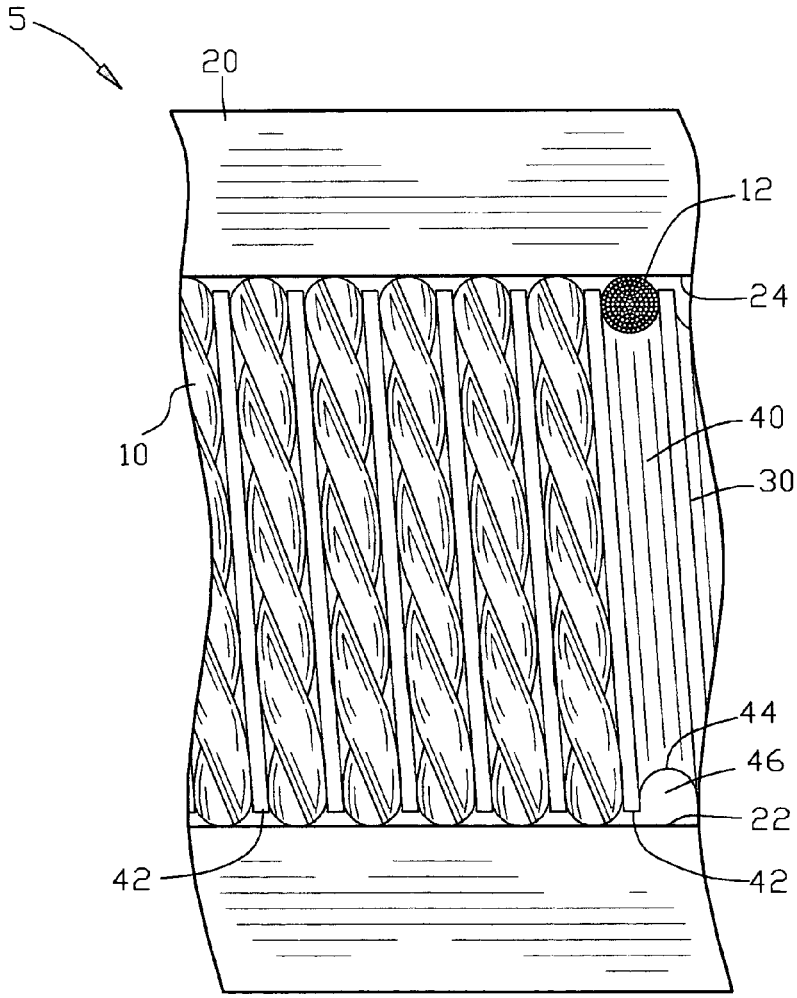
FIG. 7 is a partial bottom view of the cable winder guide.

FIGS. 6 and 7 are sectional and bottom views of the cable winder guide 5 of FIG. 4, further illustrating the dimensional relationship between the cylindrical drum 30, the helical groove 40, the cable 10 and the cable retainer 20. The first end 11 of the cable 10 is affixed to the first end 31 of the cylindrical drum 30. The cable 10 is wound around the cylindrical surface 33 of the cylindrical drum 30. Further, the cable 10 is contained within the confines of the helical groove 40 on the cylindrical surface 33 of the cylindrical drum 30.

The cable retainer 20 has a length extending between the first 21 and second 22 ends. The cable retainer length is substantially equal to the axial length of the helical groove 40 on the cylindrical surface 33 of the cylindrical drum 30. The retainer diameter 24 is defined by the relationship of the cable diameter 12, the helical groove depth 46 and the outer diameter 42 of cylindrical drum 30 as has been previously discussed.

The composition of the cable retainer 20 is a critical balance between a material that is sufficiently tough to prevent premature wear on the cable retainer 20 and sufficiently resilient to prevent wear on the cable 10. A variety of materials may be utilized in cable retainer 20. Preferably, a polymeric material similar to a mixture of polyethylene and prolypropylene has been determined to afford the best balance between the aforementioned critical balance.

Overwrapping of the cable upon previously wound portions of the cable and subsequent entanglement of the cable on the cylindrical drums of devices discussed in the prior art could occur both when under load and when the load had been relieved and cable backed off and loosened on the cylindrical drum, as is well known to those skilled in the art.

As best illustrated in FIG. 7, the cable retainer 20 ensures that the cable 10 remains captive in the helical groove 40 on the cylindrical outer surface 33 of the cylindrical drum 30. The cable 10 is held captive in the helical groove 40 in full load, as well as partial and no load conditions. The cable retainer 20 resiliently engages the cable 10 ensuring that the cable 10 remains within the confines of the helical groove 40. The cable retainer 20 may deform slightly upon engagement with the cable 10. The resilient engagement effected by the cable retainer 20 exerts an inward radial force on the cable 10 greater than any outward force of the cable 10 which may be generated by a loosening of the cable 10 tension or the like.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A cable winder guide for winding cable, comprising:
a cylindrical drum having a cylindrical surface;
a shaft rotatably mounting said cylindrical drum;
a drive for rotating said cylindrical drum about said shaft;
a helical groove defined in said cylindrical surface for retrieving and releasing the cable upon rotation of said cylindrical drum;
a cable retainer defining a substantially semi-cylindrical shape having a diameter greater than said drum diameter for maintaining said cable retainer distanced from said cylindrical drum; and
said cable retainer defining a shape having a diameter less than said drum diameter plus two cable diameters for resiliently engaging the cable when the cable is located within said helical groove for maintaining the cable within said helical groove.

2. A cable winder guide as set forth in claim 1, wherein said helical groove has a depth, wherein said depth of groove in said drum is substantially greater than one half and less than three quarters cable diameter.

3. A cable winder guide as set forth in claim 1, wherein said cable retainer comprises a polymeric material.

4. A cable winder guide as set forth in claim 1, wherein said cable retainer comprises a mixture of polyethylene and polypropylene material.

5. A cable winder guide as set forth in claim 1, wherein said cable retainer defines a length substantially equal to said helical groove in said cylindrical surface of said drum.

6. A cable winder guide as set forth in claim 1, wherein said helical groove has a depth, wherein said depth of groove in said drum is substantially greater than one half and less than three quarters cable diameters; and said cable retainer comprising a polymeric material.

7. A cable winder guide for winding cable, comprising:
a cylindrical drum having a cylindrical surface;
a shaft rotatably mounting said cylindrical drum;
a drive for rotating said cylindrical drum about said shaft;

a helical groove defined in said cylindrical surface for retrieving and releasing the cable upon rotation of said cylindrical drum;

a cable retainer comprising a polymeric material;

said cable retainer defining a substantially semi-cylindrical shape having a diameter greater than said drum diameter for maintaining said cable retainer distanced from said cylindrical drum; and said cable retainer defining a shape having a diameter less than said drum diameter plus two cable diameters for resiliently engaging the cable when the cable is located within said helical groove for maintaining the cable within said helical groove.

8. A cable winder guide as set forth in claim 7 wherein said helical groove has a depth, wherein said depth of groove in said drum is substantially greater than one half and less than three quarters cable diameters.

9. A cable winder guide as set forth in claim 7, wherein said cable retainer defines a substantially semi-cylindrical shape having a diameter greater than said drum diameter and less than said drum diameter plus two cable diameters.

10. A cable winder guide as set forth in claim 7, wherein said helical groove has a depth, wherein said depth of groove in said drum is substantially greater than one half and less than three quarters cable diameters; and said cable retainer defines a substantially semi-cylindrical shape having a diameter greater than said drum diameter and less than said drum diameter plus two cable diameters.

11. A cable winder guide as set forth in claim 7, wherein said cable retainer defines a a length substantially equal to said helical groove in said cylindrical surface of said drum.

12. A cable winder guide as set forth in claim 7, wherein said helical groove has a depth, wherein said depth of groove in said drum is substantially greater than one half and less than three quarters cable diameters; said cable retainer retainer comprising a polymeric material; and said cable retainer defines a substantially semi-cylindrical shape having a diameter greater than said drum diameter and less than said drum diameter plus two cable diameters.

13. A cable winder guide for winding cable, comprising:

a support member for supporting a first and a second journals;

a shaft rotatable engaging said first and second journals;

a cylindrical drum encircling said shaft and including a cylindrical surface;

a drive for rotating said cylindrical drum about said shaft;

a helical groove defined in said cylindrical surface for retrieving and releasing the cable upon rotation of said cylindrical drum;

a cable retainer secured to said support member and positioned between said cylindrical drum and said support member;

said cable retainer defining a substantially semi-cylindrical shape having a diameter greater than said drum diameter for maintaining said cable retainer distanced from said cylindrical drum; and said cable retainer defining a shape having a diameter less than said drum diameter plus two cable diameters for resiliently engaging the cable when the cable is located within said helical groove for maintaining the cable within said helical groove.

14. A cable winder guide as set forth in claim 13, wherein said cable retainer comprises a polymeric material.

15. A cable winder guide as set forth in claim 13, wherein said cable retainer comprises a polyethylene and polypropylene mixture material.

16. A cable winder guide as set forth in claim 13, wherein said cable retainer defines a substantially semi-cylindrical shape having a diameter greater than said drum diameter and a length substantially equal to said helical groove in said cylindrical surface of said drum.

* * * * *